US006115863A

United States Patent [19]

Mason et al.

[11] Patent Number: 6,115,863

[45] Date of Patent: Sep. 12, 2000

[54] DRIVE SYSTEM FOR A VERTICAL AXIS WASHER

[75] Inventors: Anthony Mason, St. Joseph; Victor W. Cuthbert, Sodus; Gerald L. Kretchman; David W. Carr, both of St. Joseph; Eric M. Coates, Stevensville; James P. Carow, St. Joseph, all of Mich.

[73] Assignee: Whirlpool Corporation, Benton Harbor, Mich.

[21] Appl. No.: 09/262,894

[22] Filed: Mar. 8, 1999

[51] Int. Cl.[7] ..... D06F 23/04

[52] U.S. Cl. ..... 8/159; 68/23.6; 68/131

[58] Field of Search ..... 8/159; 68/23.6, 68/131

[56] References Cited

U.S. PATENT DOCUMENTS

| | | | |
|---|---|---|---|
| 1,575,358 | 3/1926 | Munson . | |
| 1,829,006 | 10/1931 | Kautzky . | |
| 2,145,453 | 1/1939 | Miller . | |
| 2,871,689 | 2/1959 | Fields | 68/131 |
| 2,924,086 | 2/1960 | Fields | 68/23.6 |
| 2,931,201 | 4/1960 | Hubbard | 68/131 |
| 3,102,410 | 9/1963 | Doyle . | |
| 4,440,004 | 4/1984 | Bochan . | |
| 4,491,210 | 1/1985 | Mason . | |
| 5,507,053 | 4/1996 | Mueller et al. | 68/131 X |
| 5,560,460 | 10/1996 | Ezawa . | |

*Primary Examiner*—Philip R. Coe

*Attorney, Agent, or Firm*—Thomas J. Roth; Joel M. Van Winkle; Robert O. Rice

[57] ABSTRACT

A drive and support system for a bottom plate disposed in the bottom of a wash basket of an automatic washer. The bottom plate is driven to radially gyrate or wobble within the wash basket by an output shaft which extends upwardly though the bottom and is rotatable in a first and second direction. A spin tube is disposed coaxially about the output shaft and has a top end which engages the bottom of the basket. The spin tube is co-rotatable in the second direction with the output shaft. A universal joint pivotably supports the wash plate about the top end of the spin tube. Drive means connect the wash plate with the upper end of the output shaft such that the wash plate is disposed in an angled orientation when the output shaft is driven in the first direction and the wash plate is disposed in a level orientation when the output shaft is driven in the second direction. In this manner, the bottom plate is supported for wobbling during the wash portion of the wash cycle and is supported in a level orientation during the spin extraction portion of the wash cycle.

23 Claims, 7 Drawing Sheets

DRIVE SYSTEM FOR A VERTICAL AXIS WASHER

BACKGROUND OF THE INVENTION

1. Field of the Invention

The present invention relates to a vertical axis clothes washer having a bottom plate capable and more particularly to a system for mounting and driving the bottom plate selectively in either an angled or level orientation.

2. Description of Related Art

Typically, a conventional vertical axis automatic washer functions by loading fabric items or clothes to be washed into a vertically aligned wash basket disposed within a wash tub. Detergent and water are supplied into the tub and basket for forming a wash liquid such that the fabric items are completely submerged in wash liquid. A vertically orientated agitator centrally supported within the wash basket oscillates and causes the clothes to move in the wash liquid within the wash basket.

Automatic washers using vertical agitators generally require the use of a large amount of water, as much as 46 gallons to suitably wash one clothes load. This is due to the fact that for the oscillating agitator to properly apply mechanical energy to the clothes without damaging them, all of the fabric items must be substantially submerged in wash liquid. This complete submersion of the fabric items occurs during the wash cycle and each of the subsequent rinse cycles. Additionally, agitators have been know to apply mechanical energy to fabric items in a harmful manner wherein fabric items are roughly abraded.

To overcome these and other disadvantages that are associated with use of an agitator in a vertical axis washer, alternate means for inputting mechanical energy to the wash load have been contemplated. In particular, some washers have been configured to impart a gyratory or wobbling type motion to the fabric items contained in the washer.

U.S. Pat. No. 5,460,018 to Werner et al., having the same assignee as the present invention, discloses a vertical axis washer having a bottom plate that is mounted for wobbling or nutating motion in the bottom of a wash basket. The movement of the bottom plate imparts mechanical to the clothes during a wash portion of the cycle. This washer is capable of washing clothes using a relatively low quantity of wash liquid and has other beneficial characteristics.

As is common with all washers, at the completion of a wash step, the wash liquid within the washer must be drained. To promote extraction of liquid from the clothes, the wash basket is spun during the drain step in the wash cycle. In order to minimize stresses on the support suspension system for the washer as well as to minimize vibration during spin, it is desirable to have the basket and the clothes disposed therein centered about the rotational axis of the basket.

In the Werner et al. machine, the wash plate disposed at the bottom of the wash basket is supported such that the wash plate axis is at an angle relative to the center axis of the basket. As a result of the angled or canted orientation of the wash plate, the fabric items within the wash basket are typically not uniformly arranged about the center axis of the wash basket. Accordingly, during spin, the clothes within the basket create an off balance load that results in undesirable vibration.

The problem of off-balanced spinning in a washer is addressed in U.S. Pat. No. 4,440,004 to Bochan. In Bochan, the entire basket is canted with respect to a vertical reference axis during the wash portion of the cycle such that the basket is wobbled. However, during spin, the mounting means for the basket shifts the basket from a canted orientation to a vertical orientation wherein the basket axis is co-aligned with the vertical reference axis.

In contrast to the Bochan reference, in the Werner et al. machine the wash basket is fixed in a substantially vertical orientation. During the wash portion of the machine cycle, the bottom plate is driven to gyrate or wobble while the basket is prevented from rotating.

It can be understood, therefore, that the bottom plate type washer of Werner et al. offers many benefits but it is subject to undesirable forces during spin due to the unbalanced arrangement of the clothes in the wash basket. However, this off-balance problem would be substantially reduced if the bottom plate was shifted to a level orientation, having its axis perpendicular to the wash basket axis, prior to the initiation of a high speed spin cycle.

SUMMARY OF THE INVENTION

It is therefore an object of the present invention to provide a washing machine having a wash plate disposed within a wash basket wherein the wash plate is in an angled orientation for a wobble mode of operation and in a level orientation for a spin mode of operation.

It is a further object to provide a bottom, wash plate type washing machine wherein the wash plate is pivotably supported about a central axis and drivingly interconnected with an output shaft for wobbling.

It is still a further object of the present invention to provide a simple, robust and inexpensive drive system for a bottom, wash plate type washer.

According to the present invention, the foregoing and other objects are obtained by an automatic washing appliance including a wash basket having a generally cylindrical shape and a bottom wall. An output shaft is provided upwardly though the bottom wall of the wash basket and has an upper end disposed above the bottom wall of the wash basket. The output shaft is rotatable in a first and second direction. A spin tube is disposed coaxially about the output shaft and has a top end which engages the bottom wall of the basket. The spin tube is co-rotatable in the second direction with the output shaft. A wash plate is disposed within wash basket adjacent the bottom wall. A universal joint pivotably supports the wash plate about the top end of the spin tube. Drive means connect the wash plate with the upper end of the output shaft such that the wash plate is disposed in an angled orientation when the output shaft is driven in the first direction and the wash plate is disposed in a level orientation when the output shaft is driven in the second direction.

The drive means of the present invention include a hub disposed within the center of the wash plate, the hub has a generally cylindrical wall and a top wall. An inner drive member is connected to the upper end of the output shaft and includes a cam lobe extending outwardly therefrom. An outer drive member is rotatably supported about the inner drive member between a first angular position when the output shaft is driven in the first direction and a second angular position when the output shaft is driven in the second direction. The outer drive hub has a drive boss rotatably engaging the hub of the wash plate such that the wash plate extends perpendicularly about the axis of the drive boss. The outer drive member and the inner drive member are arranged such that in the first angular position, the drive boss is disposed in a canted orientation relative to the center axis of the basket such that the wash plate is oriented in a canted orientation. In the second angular position, the drive boss is co-axially aligned with the center axis such that the wash plate is in a level orientation within the wash basket.

A shift mechanism is provide for moving the wash plate from an angled orientation to the level orientation and vice versa. The shift mechanism includes a shift plate which is movably mounted to the outer drive member. The shift plate has a pair of cam surfaces. A drive lug extends inwardly from the generally cylindrical wall of the hub. A pair of pawls are pivotably connected to the shift plate and biased outwardly toward the hub. During a change in direction of the output shaft, one of the pawls engages the drive lug and ensures relative rotation between the inner and outer drive member. Moreover, after a predetermined amount of angular rotation between the inner and outer drive members, the cam lobe of the inner member engages the cam surfaces of the shift plate and moves the shift plate away from the drive lug such that the drive pawl selectively disengages the drive lug.

DESCRIPTION OF THE PREFERRED EMBODIMENT

The present invention is particularly useful on a wash plate type washer as disclosed in U.S. Pat. No. 5,460,018, to Werner et al., the disclosure of which is hereby incorporated by reference.

Figure 1:
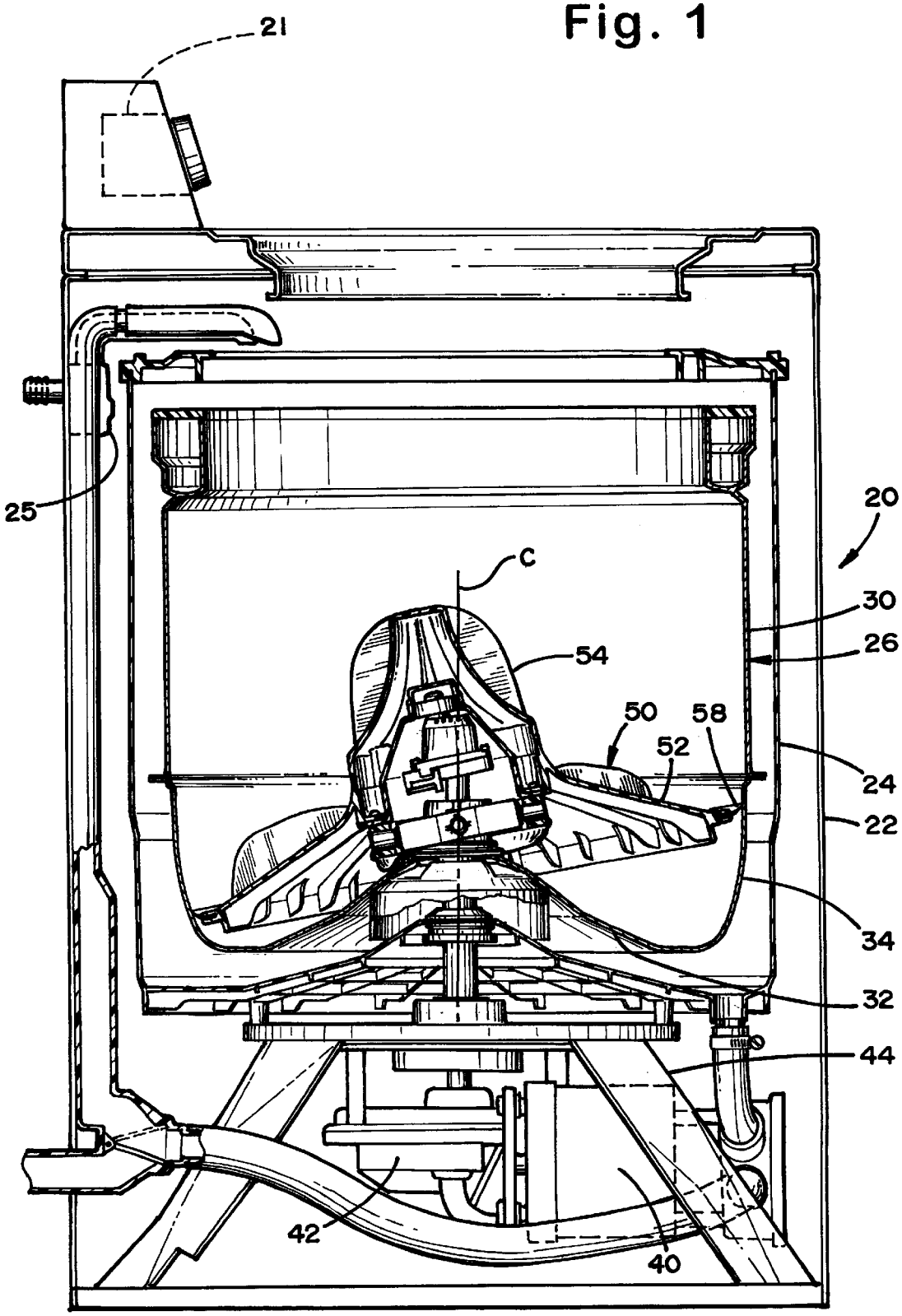
FIG. 1 is a side elevational view, partly in section, of a washing machine in accordance with the present invention, showing the wash plate in an angled orientation.

In FIG. 1, reference numeral 20 indicates generally a washing machine of the automatic type, i.e., a machine having a pre-settable sequential controller 21 for operating a washer through a preselected program of automatic washing, rinsing and drying operations in which the present invention may be embodied. The controller 21 may be an electromechanical timer type device or an electronic microprocessor. The machine 20 includes a frame or cabinet 22 surrounding a imperforate tub 24. A wash basket 26 with perforations or holes is rotatably supported within the tub. A fill valve 25 is connected to an external water supply (not shown) and is operated to inlet water into the tub 24. A hinged lid 28 is provided in the usual manner to provide access to the interior of the wash basket 26.

The wash basket 26 defines a wash chamber and includes a generally cylindrical side wall 30 having a vertical center axis C—C. The side wall 30 includes a partly spherical wall portion 34 adjacent a substantially flat bottom wall 32. A motor 40 is operatively connected to the basket 26 through a transmission 42 to rotate the basket 26 relative to the stationary tub 24. A suspension frame 44 supports the motor and tub assembly within the cabinet 22. The controller 21 is operatively interconnected with the motor and the fill valve 25 such that controller 21 can operate the washer 20 according to the selected program cycle.

Positioned within the lower portion of the wash basket 26 is a bottom plate 50 having an annular body 52 and a raised center dome 54. The annular body 52 defines a generally conically shaped body having a raised inner portion and downwardly extending toward a lower outer edge. An annular lip seal 58 extends from the outer edge of the annular body for sealingly engaging the partly spherical wall portion 34 of the basket 26. The wash plate assembly 80 has a transverse axis D—D.

Figure 2:
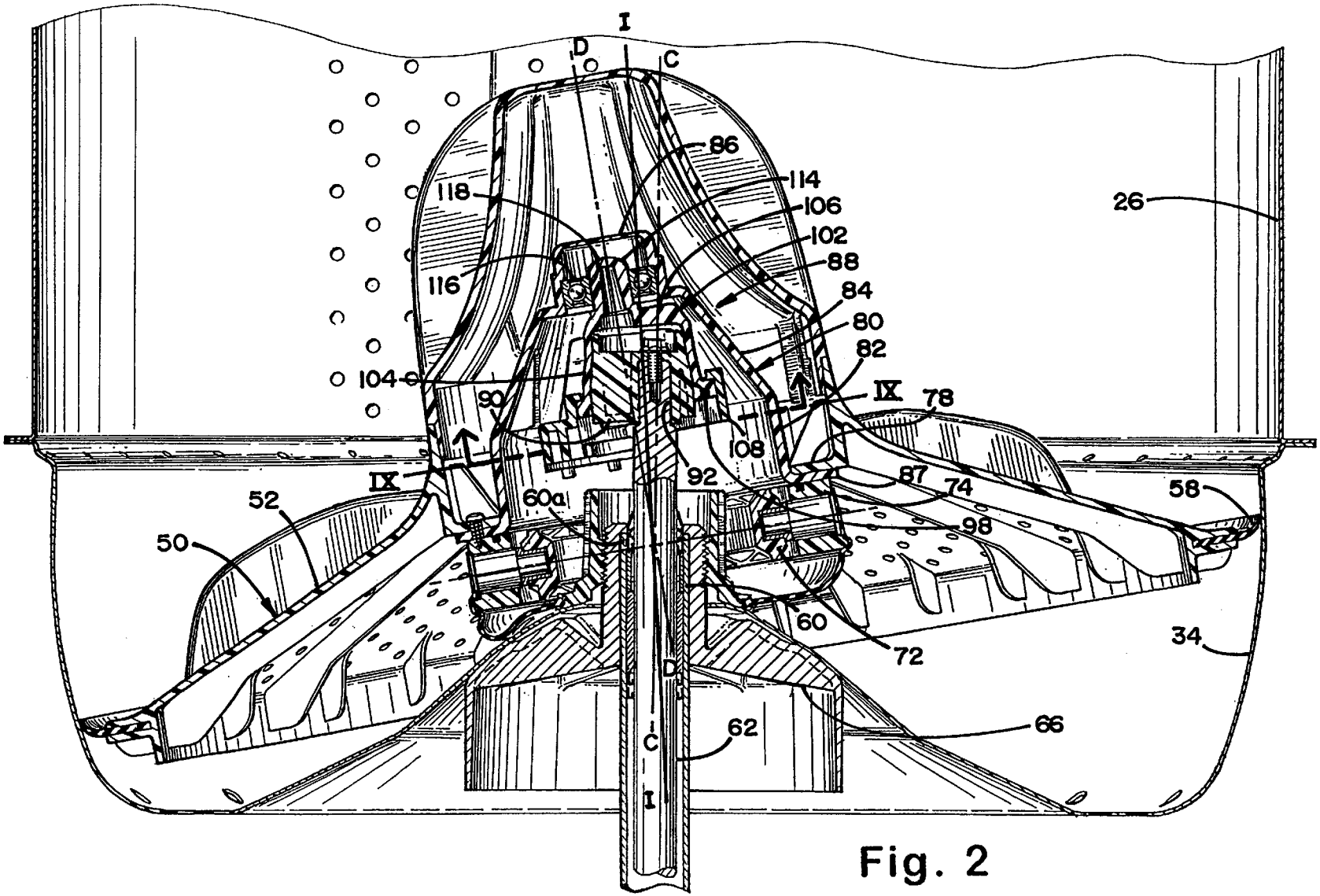
FIG. 2 is a detailed sectional view of a portion of the wash basket and wash plate of the washing machine of FIG. 1, showing the wash plate in the angled orientation.
Figure 3:
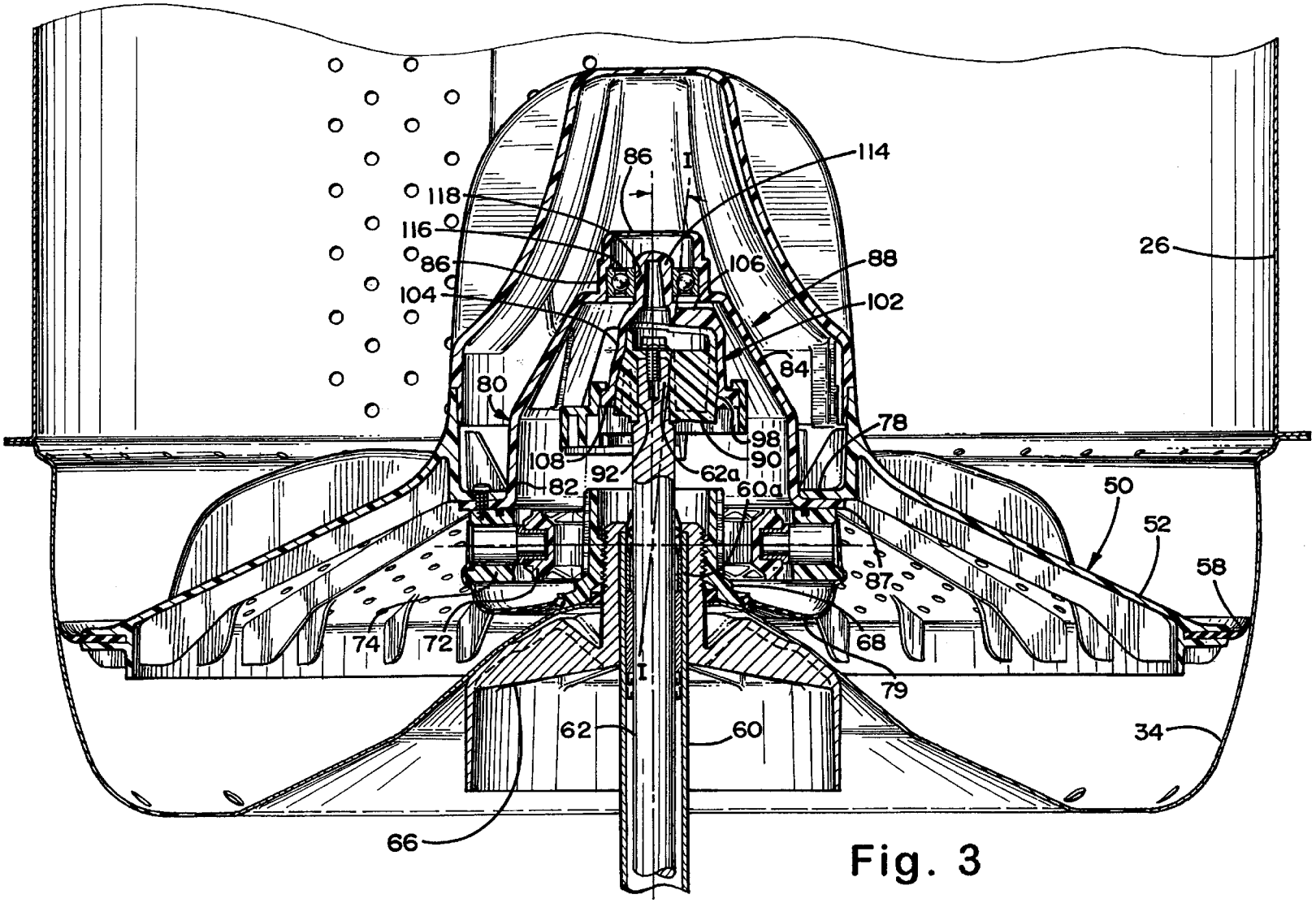
FIG. 3 is a detailed sectional view of a portion of the wash basket and wash plate of the washing machine of FIG. 1, showing the wash plate in a level orientation.

Turning now to FIGS. 2 and 3, details of the wash plate drive system can be described. It can be seen that a spin tube 60 is co-axially arranged around a output shaft 62, both of which are drivingly interconnected with the transmission 42. The axes of the spin tube 60 and the output shaft 62 are generally aligned with the center axis C—C. A brake mechanism 64 operates in association with the spin tube 60 and the output shaft 62 for braking the rotation of the spin basket 26. The brake mechanism may be of the type shown in greater detail in U.S. Pat. No. 4,254,641 to Gauer et al. having the same assignee as the present invention, the disclosure of which is hereby incorporated by reference.

The spin tube 60 sealingly extends through the tub 24 and is attached to the wash basket 26 by a drive block 66, which may be keyed to the top end 60*a* of the spin tube 60. A hold down nut 68 is threaded onto the drive block 66 such that a portion of the wash basket 26 is clamped between the drive block 66 and the hold down nut 68.

Figure 4:
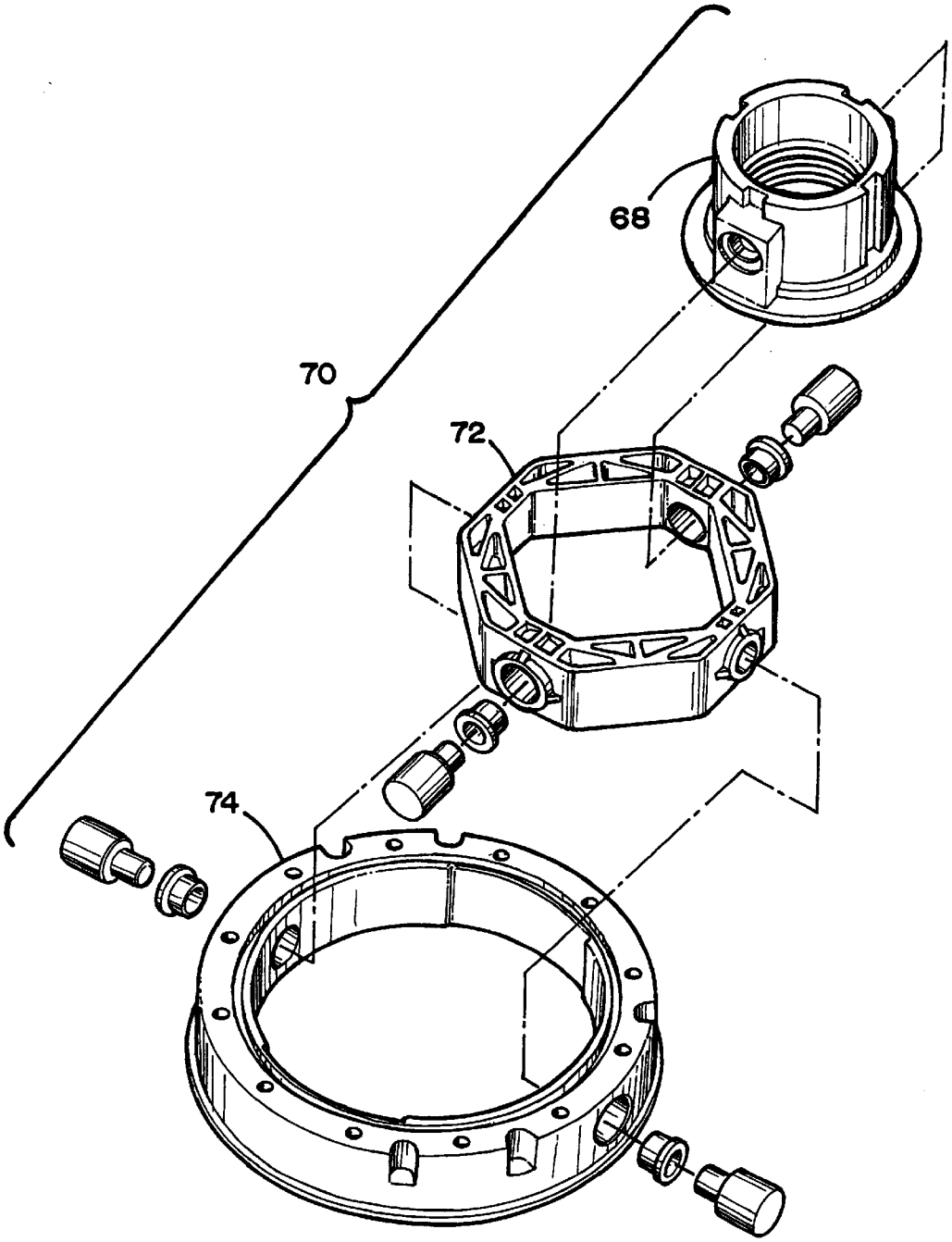
FIG. 4 is an exploded view of the universal joint for pivotably supporting the wash basket of the washing machine of FIG. 1.

A system for mounting the wash plate 50 to the spin tube 60 is provided comprising a universal joint assembly 70, shown in detail in FIG. 4, such that the wash plate 50 is allowed to radially pivot or swivel about the top end 60*a* of the spin tube 60. The universal joint assembly 70 comprises an inner ring 72 coaxially disposed about the hold down nut 68 and pivotably connected to the hold down nut 68 about a first pivot axis. An outer ring 74 is coaxially disposed about the inner ring 72 and is pivotably connected to the inner ring 72 about a second pivot axis, perpendicular to the first pivot axis. The outer ring 74 is secured to an inner flange 78 of the wash plate 50. A seal 79 is provided about the outer ring 74 and extends to the basket 26.

The output shaft 62 extends upwardly past the top end 60*a* of the spin tube 60 and terminates in an upper end 60*a* disposed within a dome like cavity formed by a center hub member 80 of the wash plate 50. The hub member 80 has a cylindrical wall portion 82 and a conical wall portion 84 which narrows toward a closed top end 86. A bottom flange 87 extends outwardly from the cylindrical wall portion 84 and is secured between the inner flange 78 of the wash plate 50 and the outer ring 74. In this manner, the hub 80 forms an inner portion of the wash plate 50 and is rigidly interconnected to the annular body 52 of the wash plate 50.

A drive assembly or system 88 is provided for interconnecting the upper end 62*a* of the output shaft 62 to the wash plate 50. The drive assembly 88 is uniquely configured to allow the wash plate 50 to be positioned in an angled or canted orientation when the output shaft 62 is rotated in a first direction, as shown in FIG. 2, and positioned in a level orientation when the output shaft 62 is rotated in a second direction, as shown in FIG. 3. When supported in the angled orientation, the wash plate 50 is freely journaled on an inclined axis that may gyrate about the center axis C—C. When supported in the level orientation, the wash plate 50 and the wash basket 26 may be rotated together such as during high speed spin extraction.

Figure 5:
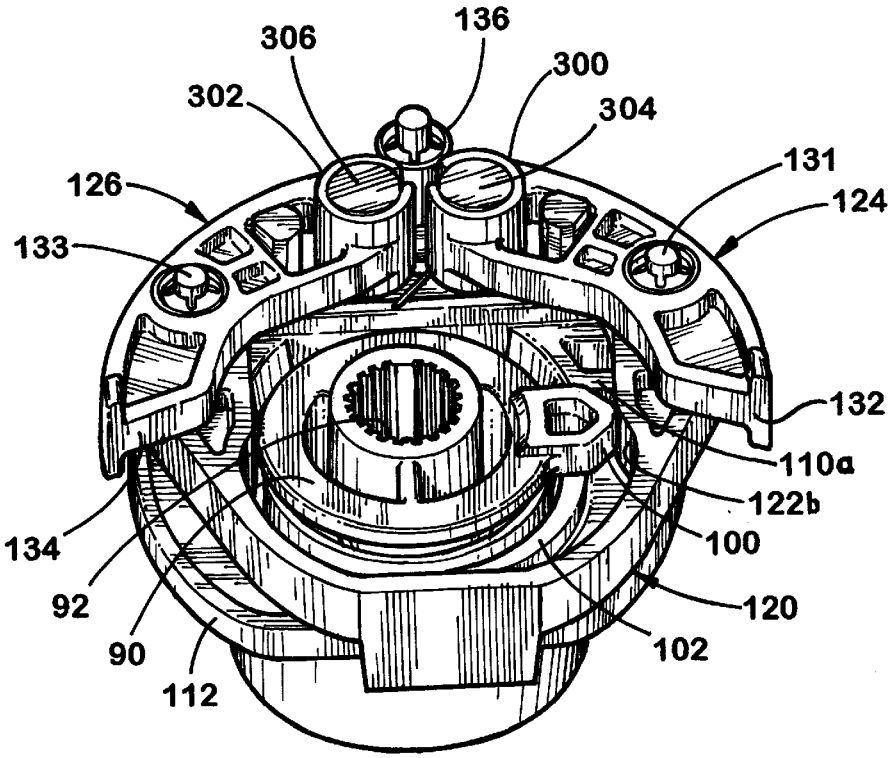
FIG. 5 is a bottom perspective view of the outer drive member, inner drive member and shift mechanism of the washing machine of FIG. 1 with the shift plate moved into a first position.
Figure 6:
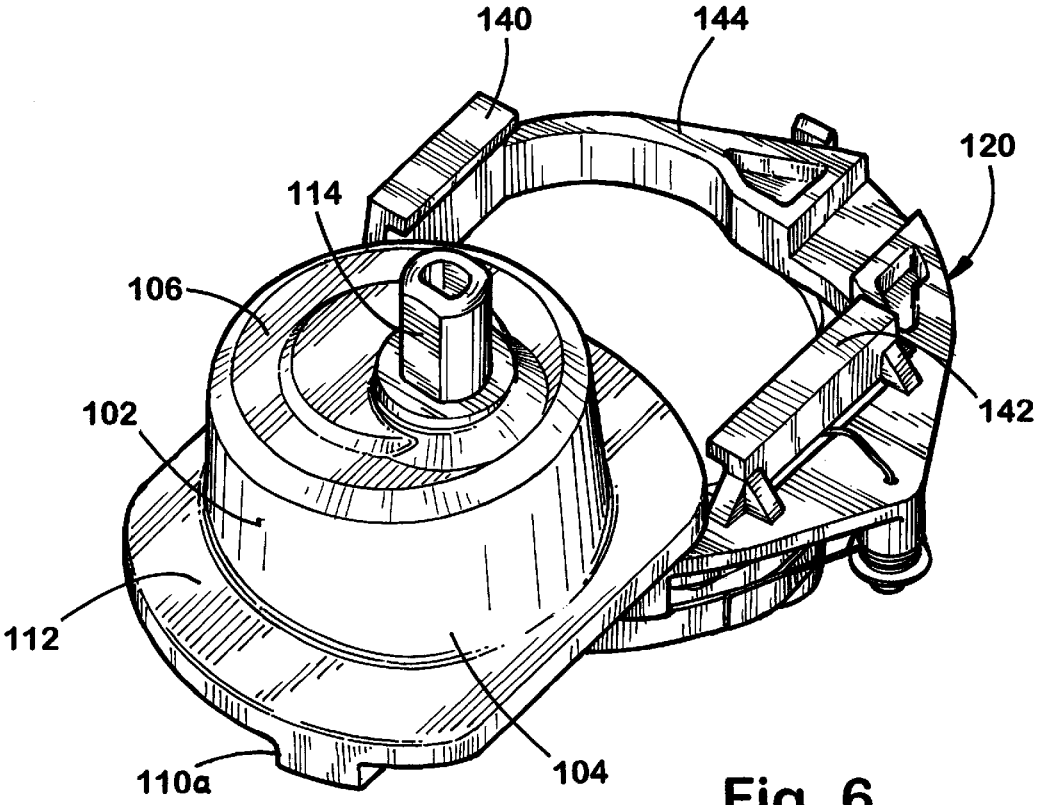
FIG. 6 is a top perspective view of the outer drive member and the shift mechanism of the washing machine of FIG. 1.
Figure 7:
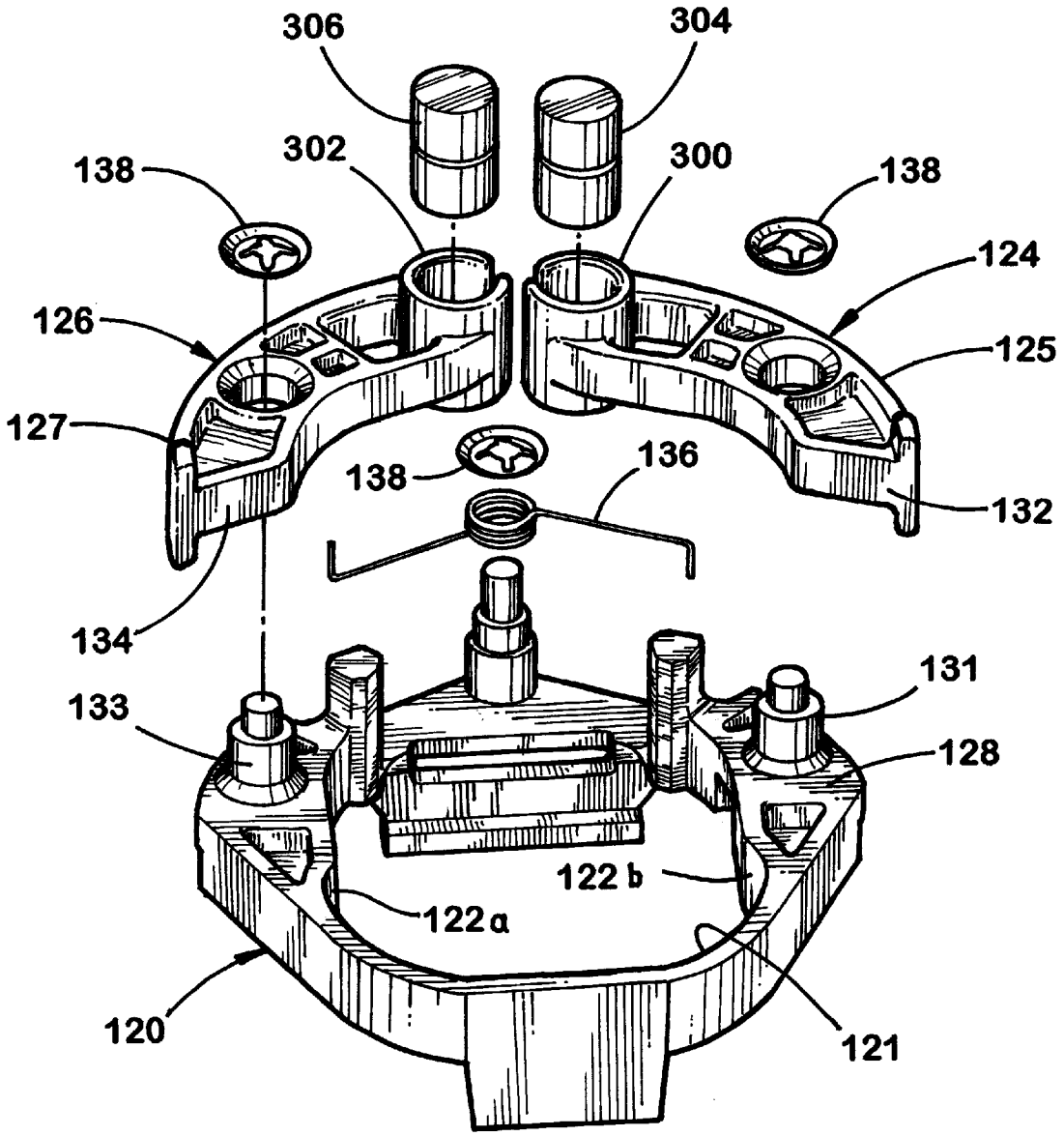
FIG. 7 is an exploded view of the shift mechanism of the washing machine of FIG. 1.

As best shown in FIGS. 5–7 with reference to FIGS. 2 and 3, the drive system 88 includes a cup shaped inner drive member 90 having an inner splined bore 92 which receives the top end 62*a* of the output shaft 62 having mating splines such that the inner drive member 90 is rigidly interconnected to the top end 62*a*. The axis of the splined bore 92 is aligned with the center axis C—C. The inner drive member 90 has a generally cylindrical outer bearing surface 98 which defines an axis I—I. The axis I—I is angularly displaced or canted relative to the axis C—C by a predetermined number of degrees such as 5°. This 5° angular displacement is referred to herein as the inner drive member angle of inclination. A cam lobe 100 extends outwardly from the bottom edge of the bearing surface 98.

An outer drive member 102, formed from either metal or plastic, is rotatably disposed about the inner drive member 90. The outer drive member includes a cylindrical wall portion 104 having a top wall 106 and a open bottom end 108 (FIGS. 2 and 3) forming a bottom opening. The cylindrical wall portion 104 forms a generally cylindrical cavity for receiving the inner drive member 90. Needle bearings may be positioned between the cylindrical interface between the drive member 90 and the cylindrical wall 104. An elongated flange portion 112 is provided along the bottom end 108 of the cylindrical wall portion 104. A pair of stop surfaces 110*a*, 110*b* downwardly protrude from the flange portion 112 and are arranged on opposite sides of the bottom opening 109. A drive boss 114 extends upwardly from the top wall 106 and has a partially cylindrical outer drive surface defining an axis D—D.

The connection between the output shaft 62 and the wash plate 50 is effected by the drive boss 114 which is rotatable received within an inner bore 118 of a bearing 116 inserted into the closed top end 86 of the wash plate hub 80. The inner bore 118 defines an axis aligned with the axis D—D. It can be understood, therefore, that the angular orientation of the drive boss 114 controls the angular orientation of the wash plate 50 which is freely journaled about the universal joint 70.

When the inner and outer drive members 90, 102 are assembled, the inner drive member 90 may rotate within the outer drive member 102. This rotation is limited, however, by interference between the cam lobe 100 and the stop surfaces 110*a*, 110*b* (see FIG. 6). The inner drive member 90 rotates through a predetermined angle of approximately 180° relative to the outer drive member 102 before the cam lobe 100 engages one of the stop surfaces preventing further relative rotation. Accordingly, the outer drive member 102 is rotatably supported about the inner drive member 90 in either a first angular position wherein the cam lobe 100 engages stop surface 110*a* or a second angular position, displaced 180° from the first angular position, wherein the cam lobe 100 engages stop surface 110*b*, depending on the direction of rotation of the output shaft 62.

The axis D—D of the drive boss 114 is angularly displaced or canted relative to the axis defined by the inner bearing surface 110 a predetermined number of degrees such as 5°. This 5° angular displacement is referred to as the outer drive member angle of inclination. When the inner drive member 90 and the outer drive member 102 are rotatably assembled together, the 5° inner drive member angle of inclination and the 5° outer drive member angle of inclination either effectively add or effectively cancel each other.

As shown in FIG. 2, when the output shaft 62 is driven in a first direction and the outer drive member 102 is in its first angular position, the respective angles of inclination of the outer drive member 102 and the inner drive member 90 add such that the axis D—D of the drive boss is inclined or canted relative to the center axis C—C an angular distance equal to the sum of the angles of inclination or 10°. In this configuration, the wash plate 50 is supported in its inclined or angled orientation for operation in a wobble mode.

In the wobble mode of operation, the brake mechanism 64 brakes the wash basket 26 from rotating while the output shaft 62 rotates in a forward direction causing the wash plate 50 to be driven in a wobbling type motion within the bottom of the wash basket 26. The wobbling motion of the wash plate 50 generally consists of a gyratory oscillation of the wash plate 50 in such a manner that each point on the periphery of the wash plate 50 is individually, and successively in one direction, raised to a maximum upper limit and then lowered to a minimum lower limit in a wave-like or undulatory motion so that the high point of the wash plate 50 periphery gyrates precessionally about the center axis C—C.

When the output shaft 62 reverses direction and the outer drive member 102 is in its second angular position, shown in FIG. 3, the respective angles of inclination of the outer drive member 102 and the inner drive member 90 cancel each other such that the axis D—D of the drive boss is co-aligned with the center axis C—C. In this configuration, the wash plate is supported in its level orientation for operation in a high speed spin mode. In the spin mode, the brake releases the wash basket 26, and the spin tube 60 and output shaft 62 are co-rotated such that the basket 26 and wash plate 50 rotated together in a reverse direction at a high speed for wash liquid extraction from the clothes.

As described above, therefore, it can be understood that the wash plate 50 is selectively positioned in an angled orientation or level orientation responsive to the direction of rotation of the output shaft 62. A problem, however, arises by the fact that the bearing engagement between the drive boss 114 and the bearing 116 and the bearing engagement between the inner drive member 92 and the outer drive member 102 are in series. When using the rotational direction of the output shaft 62 to change the angle of the wash plate 50, it is necessary to force relative rotation between the drive members 90, 102. However, rotation may occur between the drive boss 114 and the bearing 116 rather than between the drive members 90, 102. Alternatively, rotation may occur between the drive boss 114 and the bearing 116 before rotation between the drive members 90, 102 is complete. Accordingly, it is necessary to provide a positive latch means or shifting means to assure a complete shift in the wash plate orientation from one position to another.

To achieve this positive shifting function, the drive system 88 is provided with a means for selectively engaging the outer drive member 102 to the hub member 80 while the inner drive member 90 rotates through the predetermined angle of approximately 180° relative to the outer drive member 102. The engagement means must be such that the outer drive member 102 is released from the hub member 80 once the shifting of the wash plate orientation occurs since the outer drive member 102 rotates relative to the hub 80 during the wobbling mode of operation.

As shown in detail in FIG. 7, the drive system 90 is provided with a shift mechanism or assembly including a shift plate 120 having a generally annular body provided with a center opening 121 having cam surfaces 122*a*, 122*b*. A pair of pawls 124 and 126 are pivotably supported along the bottom surface 128 of the shift plate 120 about pivot pins 131, 133 located on the shift plate 120. Each of the pawls 124, 126 have an outer engagement end 132, 134 and a counter weight end 300, 302. The counter weight ends each received cylindrical weights 304, 306. The pawls further include a radiused outer surface 125, 127. The outer engagement ends 132, 134 are biased outwardly away from the center of the shift plate 120 by a spring 136. Retainers 138 secure the pawls 124, 126 and the spring 136 to the shift plate 120.

During operation when the drive shaft 62 is rotating at a relatively low speed such as during a steady state wobble mode, the torsion spring 136 biases the outer ends 132, 134 away from the center of the shift plate 120. However, when the drive shaft is rotating a relatively high speed, such as during an extraction spin mode, the counter weights 300, 302 are centrifugally urged outwards, retracting the outer engagement ends 132, 134.

The shift plate 120 includes a pair of L-shaped channel ribs 140, 142 extending upwardly from a top surface 144, as best seen in FIG. 5. The channel ribs 140, 142 define a pair of slots for slidingly receiving the edges of the elongated flange portion 112 of the outer drive member 102. In this manner, the shift plate 120 is movably supported adjacent the outer drive member 102 for rectilinear motion.

When the drive system 88 is fully assembled, the shift plate 120 is slidingly mounted to the outer drive member 102. The inner drive member 90 is mounted to the output shaft 62 and is received into the outer drive member 102 such that the inner drive member 90 is received up through the center opening 121 of the shift plate 120. As the inner drive member 90 rotates within the outer drive member 102, the cam lobe 100 engages the cam surfaces 122*a* and 122*b* for moving the shaft plate 120 between two predetermined positions, as best seen in FIGS. 6 and 7. In a first position, shown in FIG. 5, the shift plate 120 is shifted to a right position. In a second position (not shown), the shift plate 120 is shifted to a left position.

Figure 8:
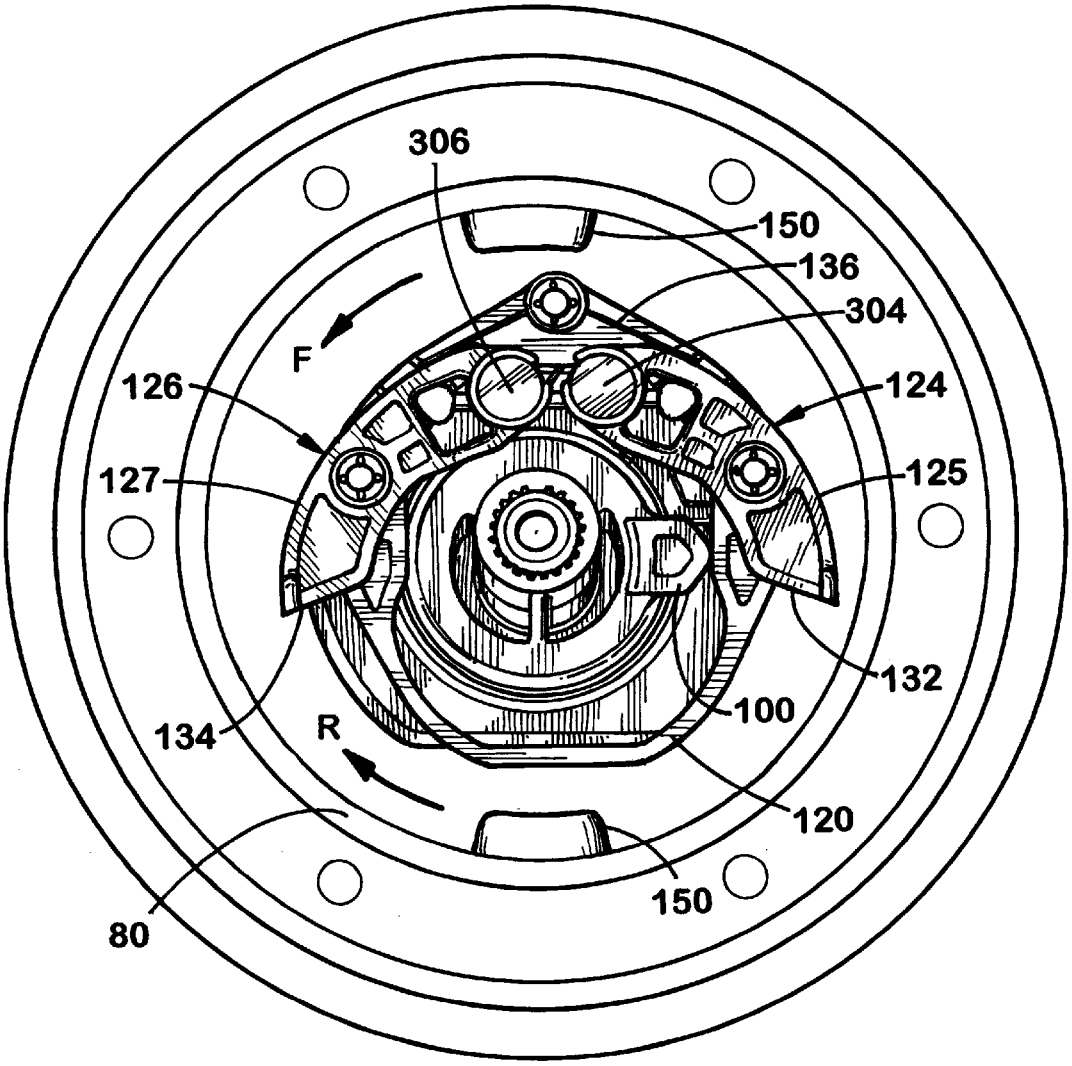
FIG. 8 is a view taken along line 9—9 of FIG. 2 with the wash plate positioned in an angled orientation.

Turning now to FIG. 8, the operation of the shifting system can be understood. The shift plate 120 and pawls 124 and 126 are sized such that depending on the position of the shift plate with respect to the outer drive member 102, either the first pawl 124 or the second pawl 126 is disposed adjacent the inner surface of the hub 80. With the machine operating in the wobble mode and the output shaft rotating in the first direction F, as shown in FIG. 8, the shift plate 120 is in its first or right shifted position such that the first pawl 124 is moved toward the hub 80 inner wall and the second pawl 126 is moved away from the hub 80 inner wall. During the wobble mode, the outer drive member 102 rotates relative to the hub 80 such that as pawls 124 and 126 rotate within the hub 80 they travel past indented portions or drive lugs 150 extending inwardly from the hub 80 inner wall. In the right shifted position, the engagement end 134 of the second pawl 126 clears the drive lugs 150 while the radiused outer surface of the first pawl contacts the lugs 150 and allows the first pawl 124 to resiliently travel over the lugs 150.

When the machine cycle shifts from a wobble mode to a spin mode, the output shaft 62 reverses direction, labeled R. In the reverse direction, with the shift plate in the right shifted position, the first pawl 124 will rotate within the hub 80 until the engagement end 132 contacts the lugs 150 and prevents further rotation of the outer drive member 102 within the hub 80. With the outer drive member 102 selectively engaging the hub 80, the inner drive member 90 is allowed to rotate relative to the outer drive member 102 such that the wash plate 50 is shifted to a level orientation. However, as the inner drive member 90 completes its rotation through the predetermined angle of approximately 180° within the outer drive member 102, the cam lobe 100 engages the cam surface 122*a* causing the shift plate 120 to shift from the right shifted position to its second or left shifted position. When shifted to its left shifted position, the first pawl 124 is shifted away from the inner surface of the hub 80 thereby releasing the first pawl from the lugs 150.

During the spin mode, the engagement ends 132, 134 of the first and second pawls 124, 126 are retracted by operation of the counter weight which under centrifugal force overcomes the spring 136 and draws the engagement ends 132, 134 inward. In this manner, the engagement ends do not contact the lugs 150. However, in the spin mode, since both the wash plate 50 is rotating, there will be little relative rotation between the outer drive member 102 and the hub 80.

When the machine cycle shifts from a spin mode back to a wobble mode, the output shaft 62 reverses direction again to run in the forward direction F. In the forward direction, with the shift plate 120 in the left shifted position, the second pawl 126 will rotate within the hub 80 until its engagement end 134 contacts the lugs 150 and prevents further rotation of the outer drive member 102 within the hub 80. With the outer drive member 102 selectively engaging the hub 80, the inner drive member 90 is allowed to rotate relative to the outer drive member 102 such that the wash plate 50 is shifted back to and angled or canted orientation. However, as the inner drive member 90 completes its rotation through the predetermined angle of approximately 180° within the outer drive member 102, the cam lobe 100 engages the cam surface 122*b* causing the shift plate 120 to shift from the left shifted position back to the right shifted position.

When shifted to the right shifted position, the second pawl 126 is shifted away from the inner surface of the hub 80 thereby releasing the its engagement end 134 from the lugs 150 whereby the outer drive member 102 may rotate freely within the hub 80 as described above.

As can be understood from the above description, for proper shifting of the wash plate 50 from a level orientation to a angled orientation or vice versa, there must be relative movement between the outer drive member 102 and the hub 80. During the wobble mode, this requirement is easily met because the brake 64 engages the wash basket 26 and prevents the wash plate 50 from rotating as the output shaft 62 rotates the outer drive member 102. However, during the spin mode, the wash basket 26 is rotated such that the hub 80 rotates with the outer drive member 102. Accordingly, to ensure proper shifting of the wash plate 50, a limited amount of relative rotation between the hub 80 and the outer drive member 102 occurs at the start of every spin period. This is achieved by using the brake 64 to secure the basket 26 for a limited period at the beginning of each spin period while the transmission allows for a limited amount of lost motion at the beginning of each spin period when the output shaft 62 rotates while the spin tube 60 is held fixed.

It can be seen, therefore, that the present invention provides a reliable and cost effective means for shifting a bottom plate in an automatic washer between a canted or angled orientation to a level orientation. Moreover, the present invention provides a structure for supporting a bottom plate to move in a gyratory type wobbling motion.

While the present invention has been described with reference the above described embodiments, those of skill in the Art will recognize that changes may be made thereto without departing from the scope of the invention as set forth in the appended claims.

We claim:

1. An automatic washing appliance comprising:

a wash basket having a generally cylindrical shape and a bottom portion having a bottom wall, the cylindrical wall defining a substantially vertical central axis;

an output shaft extending upwardly though the bottom wall of the wash basket and having an upper end disposed above the bottom wall, the output shaft being rotatable in a first and second direction;

a generally circular wash plate disposed within the bottom portion of the wash basket, the wash plate defining a wash plate axis and having a center hub disposed about the upper end of the output shaft; and drive means interconnecting the upper end of the output shaft with the wash plate, the drive means supporting the wash plate in an angled orientation such that the wash plate axis is canted relative to the central axis of the wash basket when the output shaft is rotated in it first direction and supporting the wash plate in a level orientation such that the wash plate axis coaligns with the central axis of the wash basket when the output shaft is rotated in its second direction.

2. The automatic washing appliance according to claim 1, further wherein the hub has a generally cylindrical wall and a top wall, the drive means further comprising:

a drive lugs extending inwardly from the generally cylindrical wall of the hub;

an inner drive member rigidly mounted to the upper end of the output shaft;

an outer drive member rotatably supported about the inner drive member between a first angular position when the output shaft is driven in the first direction and a second angular position when the output shaft is driven in the second direction, the outer drive member having a drive boss rotatably engaging the top wall of the hub; and a movable drive pawl mounted to the outer drive member for selectively engaging the drive lug of the hub to ensure relative rotation between the inner drive member and the outer drive member when the output shaft reverses direction.

3. The automatic washing appliance according to claim 1, further comprising:

a spin tube extending co-axially about the output shaft and having a top end extending through the bottom wall of the wash basket; and a universal joint pivotably supporting the wash plate about the top end of the spin tube.

4. The automatic washing appliance according to claim 3, wherein the universal joint further comprises:

a hold down nut engaging the top end of the spin tube;

an inner ring pivotably supported on a first axis about the hold down nut; and an outer ring pivotably supported on a second axis about the inner ring, the outer ring being connected to the wash plate.

5. An automatic washing appliance comprising:

a wash basket having a generally cylindrical shape and a bottom wall;

an output shaft extending upwardly though the bottom wall of the wash basket and having an upper end disposed above the bottom wall, the output shaft being rotatable in a first and second direction;

a wash plate supported for radially pivoting within the wash basket adjacent the bottom end, the wash plate having a center hub disposed about the upper end of the output shaft;

an inner drive member drivingly connected to the upper end of the output shaft; and an outer drive member rotatably engaging the center hub of the wash plate and controlling the angular orientation of the wash plate, the outer drive member being rotatably supported about the inner drive member between a first angular position wherein the outer drive member is canted relative to the center axis of the wash basket when the output shaft is driven in the first direction and a second angular position wherein the outer drive member is co-aligned with the center axis of the wash basket when the output shaft is driven in the second direction.

6. The automatic washing appliance according to claim 5, further comprising:

means for selectively engaging the outer drive member to the center hub to cause relative rotation between the inner drive member and the outer drive member when the output shaft reverses direction for shifting the wash plate from an angled orientation to a level orientation and vice versa.

7. The automatic washing appliance according to claim 6, wherein the engaging means further comprises:

a shift mechanism movably mounted to the outer drive member for selectively engaging the outer drive member to the wash plate hub.

8. The automatic washing appliance according to claim 7, wherein the shift mechanism further comprises:

a drive lug extending inwardly from the hub of the wash plate;

a shift plate movably mounted to the outer drive member, the shift plate having a pair of cam surfaces;

a pair of pawls pivotably connected to the shift plate and biased outwardly toward the hub of the wash plate;

wherein when the output shaft reverses direction, one of the pawls engages the drive lug and after a predetermined amount of relative rotation between the inner and outer drive members the inner drive member engages one of the cam surfaces and shifts the shift plate away from the drive lug.

9. The automatic washing appliance according to claim 5, further comprising:

a spin tube extending co-axially about the output shaft and having a top end extending through the bottom wall of the wash basket; and a universal joint pivotably supporting the wash plate about the top end of the spin tube.

10. The automatic washing appliance according to claim 9, wherein the universal joint further comprises:

a hold down nut engaging the top end of the spin tube;

an inner ring pivotably supported on a first axis about the hold down nut; and an outer ring pivotably supported on a second axis about the inner ring, the outer ring being connected to the wash plate.

11. A drive system interconnected between an upper end of an output shaft and a wash plate pivotably supported within a wash basket of an automatic washer where the output shaft is rotatable in a first and second direction, the drive system comprising:

a hub extending from the center of the wash plate, the hub having a generally cylindrical wall and a top wall;

a drive lug extending inwardly from the generally cylindrical wall of the hub;

an inner drive member rigidly mounted to the upper end of the output shaft;

an outer drive member having a drive boss rotatably engaging the wash plate for controlling the angular orientation of the wash plate, the outer drive member being rotatably supported about the inner drive member between a first angular position where the wash plate is supported in an angled orientation when the output shaft is driven in the first direction and a second angular position wherein the wash plate is supported in a level orientation when the output shaft is driven in the second direction; and a movable drive pawl mounted to the outer drive member for selectively engaging the drive lug of the hub to ensure relative rotation between the inner drive member and the outer drive member when the output shaft reverses direction.

12. The drive system according to claim 11, further comprising:

a shift plate movably mounted to the outer drive member, the shift plate having a pair of cam surfaces, the shift plate further pivotably supporting the drive pawl which is biased outwardly toward the hub; and a cam lobe extending outwardly from the inner drive member, wherein during relative rotation between the inner drive member and the outer drive member, the cam lobe engages the cam surfaces for moving the shift plate between a right shifted position and a left shifted position such that the drive pawl selectively engages the drive lug.

13. The drive system according to claim 12, wherein the movable drive pawl has an engagement end and a counter weight end on opposite sides of the pivot point such that when the output shaft rotates at low speeds the engagement end extends outwardly toward the hub but when the output shaft rotates at high speeds the engagement end is retracted.

14. An automatic washing appliance comprising:

a wash basket having a generally cylindrical shape and a bottom wall;

an output shaft extending upwardly though the bottom wall of the wash basket and having an upper end disposed above the bottom wall, the output shaft being rotatable in a first and second direction;

a spin tube disposed coaxially about the output shaft and having a top end engaging the bottom wall of the basket, the spin tube being co-rotatable in the second direction with the output shaft;

a wash plate disposed within wash basket adjacent the bottom wall of the wash basket;

means for pivotably supporting thc wash plate about the top end of the spin tube; and means for drivingly connecting the wash plate with the upper end of the output shaft such that the wash plate is disposed in an angled orientation when the output shaft is driven in the first direction and the wash plate is disposed in a level orientation when the output shaft is driven in the second direction.

15. The automatic washing machine according to claim 14, further comprising:

a universal joint pivotably supporting the wash plate about the top end of the spin tube such that the wash plate may radially pivot about a vertical axis.

16. The automatic washing appliance according to claim 15, wherein the universal joint further comprises:

a hold down nut engaging the top end of the spin tube;

an inner ring pivotably supported on a first axis about the hold down nut; and an outer ring pivotably supported on a second axis about the inner ring, the outer ring being connected to the wash plate.

17. The automatic washing machine according to claim 14, wherein the wash basket defines a center axis, the washing machine further comprising:

a hub disposed within the center of the wash plate, the hub having a generally cylindrical wall and a top wall;

a drive lug extending inwardly from the generally cylindrical wall of the hub;

an inner drive member connected to the upper end of the output shaft, the inner drive member including a cam lobe extending outwardly therefrom;

an outer drive member supported about the inner drive member between a first angular position when the output shaft is driven in the first direction and a second angular position when the output shaft is driven in the second direction, the outer drive hub rotatably engaging the hub of the wash plate wherein in the first angular position, the outer drive member is disposed in a canted orientation relative to the center axis of the basket such that the wash plate is oriented in a canted orientation and in the second angular position, the outer drive member is co-axially aligned with the center axis such that the wash plate is in a level orientation within the wash basket;

a shift plate movably mounted to the outer drive member, the shift plate having a pair of cam surfaces; and a pawl pivotably connected to the shift plate and biased outwardly toward the hub, wherein the cam lobe engages the cam surfaces for moving the shift plate between a right shifted position and a left shifted position such that the drive pawl selectively engages the drive lug.

18. The drive system according to claim 17, wherein the movable drive pawl has an engagement end and a counter weight end on opposite sides of the pivot point such that when the output shaft rotates at low speeds the engagement end extends outwardly toward the hub but when the output shaft rotates at high speeds the engagement end is retracted.

19. An automatic washing appliance comprising:

a wash basket having a generally cylindrical shape defining a center axis and a bottom wall;

an output shaft extending upwardly though the bottom wall of the wash basket and having an upper end disposed above the bottom wall, the output shaft being rotatable in a first and second direction;

a spin tube disposed coaxially about the output shaft and having a top end engaging the bottom wall of the basket, the spin tube being co-rotatable in the second direction with the output shaft;

a wash plate disposed within wash basket adjacent the bottom end, the wash plate having a center hub disposed about the upper end of the output shaft;

a universal joint for pivotably supporting the wash plate about the top end of the spin tube;

an inner drive member connected to the upper end of the output shaft; and an outer drive member rotatably engaging the center hub of the wash plate, the outer drive member supported about the inner drive member between a first angular position where in the outer drive member is dis posed in a canted position relative to the center axis of the basket and a second angular position wherein the outer drive member is co-axially aligned with the center axis.

20. The automatic washing appliance according to claim 18, further comprising:

means for selectively engaging the outer drive member to the wash plate hub to cause relative rotation between the inner drive member and the outer drive member when the output shaft reverses direction.

21. The automatic washing appliance according to claim 19, further comprising:

a drive lug extending inwardly from the hub of the wash plate;

a shift plate movably mounted to the outer drive member, the shift plate having a pair of cam surfaces;

a pair of pawls pivotably connected to the shift plate and biased outwardly toward the hub of the wash plate;

wherein when the output shaft reverses direction, one of the pawls engages the drive lug and the inner drive member engages one of the cam surfaces for shifting the shift plate away from the drive lug after a predetermined amount of relative rotation between the inner and outer drive members.

22. A method for operating an automatic washer having a wash basket rotatably supported within a tub, a water inlet system for supplying water into the tub, a wash plate supported within the bottom portion of the wash basket and a drive system including a motor and an output shaft for selectively wobbling the wash plate within the wash tub while securing the wash basket against rotation and for co-rotating the wash basket and the wash plate during a spin extraction step, the method of operating the wash basket comprising:

loading fabric items within the wash basket;

supplying wash liquid into the wash basket;

supporting the wash plate in an angled orientation within the bottom of the wash basket;

wobbling the wash plate such that the fabric items are agitated within the wash basket;

leveling the wash plate; and then rotating the wash basket and the wash plate after the wash plate has been moved to a level orientation within the wash basket while draining wash liquid from the tub.

23. A method for operating an automatic washer according to claim 22, further comprising:

moving the wash plate to an angled orientation within the wash basket after the wash liquid has been drained from the tub;

supplying wash liquid into the wash basket;

wobbling the wash plate such that the fabric items are agitated within the wash basket;

leveling the wash plate; and then rotating the wash basket and the wash plate after the wash plate has been moved to a level orientation within the wash basket while draining wash liquid from the tub.

* * * * *